US005980655A

United States Patent [19]

Kosaka

[11] Patent Number: 5,980,655

[45] Date of Patent: Nov. 9, 1999

[54] TITANIUM-ALUMINUM-VANADIUM ALLOYS AND PRODUCTS MADE THEREFROM

[75] Inventor: Yoji Kosaka, Salem, Oreg.

[73] Assignee: Oremet-Wah Chang, Albany, Oreg.

[21] Appl. No.: 09/058,049

[22] Filed: Apr. 9, 1998

Related U.S. Application Data

[60] Provisional application No. 60/043,559, Apr. 10, 1997.

[51] Int. Cl.[6] ..... C22C 14/00

[52] U.S. Cl. ..... 148/421; 420/420

[58] Field of Search ..... 148/421; 420/420

[56] References Cited

U.S. PATENT DOCUMENTS

| | | | |
|---|---|---|---|
| 4,943,412 | 7/1990 | Bania et al. | 420/420 |
| 5,332,545 | 7/1994 | Love | 420/420 |
| 5,509,979 | 4/1996 | Kimura | 148/421 |
| 5,558,728 | 9/1996 | Koabayashi et al. | 148/421 |
| 5,759,484 | 6/1998 | Kashii et al. | 420/420 |

FOREIGN PATENT DOCUMENTS

| | | |
|---|---|---|
| 611831 | 8/1994 | European Pat. Off. . |
| 683242 | 11/1995 | European Pat. Off. . |

OTHER PUBLICATIONS

English–language abstract of Japanese Patent Application No. 01270231, Jun. 7, 1991.

*Primary Examiner*—John P. Sheehan

*Attorney, Agent, or Firm*—Klarquist Sparkman Campbell Leigh & Whinston, LLP

[57] ABSTRACT

Titanium alloys comprising from about 2.5% to about 5.4% aluminum, from about 2.0% to about 3.4% vanadium, from about 0.2% to about 2.0% iron, and from 0.2% to about 0.3% oxygen are described. Such alloys also can comprise elements selected from the group consisting of chromium, nickel, carbon, nitrogen, perhaps other trace elements, and mixtures thereof, wherein the weight percent of each such element is 0.1% or less, and wherein the total weight of such elements is generally about 0.5% or less. A method for producing titanium alloys also is described. The method first comprises providing an ingot having the composition described above, and then α-β processing the ingot to provide an α-β alloy. Armor plates comprising an α-β-processed titanium alloy also are described, as well as a method for making such armor plates. Armor plates produced according to the method with thicknesses of from about 0.625 inch to about 0.679 inch (from about 15.9 mm to about 17.2 mm) have $V_{50}$ values of about 600 m/s or greater.

16 Claims, 1 Drawing Sheet

TITANIUM-ALUMINUM-VANADIUM ALLOYS AND PRODUCTS MADE THEREFROM

CROSS REFERENCE TO RELATED APPLICATION

This application claims priority from copending U.S. Provisional Patent Application No. 60/043,559, filed on Apr. 10, 1997, which is incorporated herein by reference.

FIELD OF THE INVENTION

This invention concerns titanium alloys comprising aluminum, vanadium, iron and a relatively high oxygen content, and products made using such alloys, including ballistic armor.

BACKGROUND OF THE INVENTION

In 1950, Pitler and Hurlich concluded that titanium showed promise as a structural armor against small-arms projectiles. Pitler et al.'s *Some Mechanical and Ballistic Properties of Titanium and Titanium Alloys,* Watertown Arsenal Laboratory (March, 1990). Titanium alloys are now being investigated for the same purpose. Ti—6Al—4V alloys, for example, have been used to form ballistic armor. See, for example, Hickey Jr. et al.'s *Ballistic Damage Characteristics and Fracture Toughness of Laminated Aluminum* 7049-773 *and Titanium* 6Al—4V Alloys, Watertown Arsenal Laboratory (March, 1980). The Ti—6Al—4V alloys comprise, as the name implies, titanium, 6 weight percent aluminum and 4 weight percent vanadium. Most of the Ti—6Al—4V alloys have relatively low oxygen concentrations of less than 0.20% by weight [all percents stated herein with respect to alloy compositions are percents relative to the total weight of the alloy, unless stated otherwise]. Ti—6Al—4V alloys having higher oxygen concentrations also are known, and such alloys have been used to produce ballistic plates. Love's U.S. Pat. No. 5,332,545, for example, describes ballistic plates made from a Ti—6Al—4V alloy. Love's alloy has a preferred composition of 6.2% aluminum, 4.0% vanadium and 0.25% oxygen.

Another titanium alloy that has been used to produce ballistic armor is discussed in J. C. Fanning's *Terminal Ballistic Properties of TIMETAL® 62S, Titanium '95: Science And Technology* (1996). Fanning describes a titanium alloy having 6.0% aluminum, 2.0% iron, a relatively low oxygen content of 0.18%, less than 0.1 weight percent vanadium and perhaps other trace elements. One measure of the effectiveness of ballistic plates is the average velocity ($V_{50}$) of a shell, such as a 20 mm fragment-simulated projectile (FSP), required to penetrate such plates. Plates fashioned from Fanning's alloy were tested using the army's 20 mm FSP test. The $V_{50}$ Fanning reported for such plates is 548 m/s. Id., Table III, page 1691. This $V_{50}$ value is representative of most titanium alloys, which generally have $V_{50}$ values for plates having thicknesses similar to Fanning's of less than 600 m/s.

The current military minimum $V_{50}$ for a 0.625 inch (15.6 mm) thick plate made from Ti—6Al—4V ELI (extra low interstitial oxygen) using a 20 mm FSP test is 583 m/s. See military standard MIL-A-46077. For armor plates having a thickness of 16.1 mm to 16.9 mm, the $V_{50}$ values currently required by the military range from 591 m/s to 612 m/s.

The Ti—6Al—4V alloys have been used to produce ballistic armor because they provide better ballistic results using less mass than steel or aluminum alloys against most ballistic threats. Titanium alloys are therefore referred to as being "more mass efficient" with respect to ballistic properties than steel or aluminum alloy. But, the $V_{50}$ values of known titanium alloys are not entirely satisfactory, and such alloys are expensive to produce. As a result, there is a need for titanium alloys that can be formed less expensively than conventional titanium alloys, and which can be formed into ballistic plates having $V_{50}$ values that meet or exceed current military standards.

SUMMARY OF THE INVENTION

The present invention provides novel titanium alloys and ballistic plates made from such alloys. These alloys can be produced less expensively than conventional Ti—6Al—4V or Ti—6Al—4V ELI alloys. Furthermore, ballistic plates made from such alloys have $V_{50}$ values equal to or exceeding plates made from most conventional titanium alloys, as well as the current military standards, as determined by FSP ballistic tests.

The titanium alloys of the present invention comprise from about 2.5% to about 5.4% aluminum, from about 2.0% to about 3.4% vanadium, from about 0.2% to about 2% iron, and at least 0.2% to about 0.3% oxygen. Such alloys also can comprise elements selected from the group consisting of chromium, nickel, carbon, nitrogen, perhaps other trace elements, and mixtures thereof, wherein the weight percent of each such element is about 0.1 % or less, and wherein the total weight of such elements generally is about 0.5% or less.

A method for producing titanium alloys also is described comprising α-β processing a titanium ingot having the composition stated above. α-β processing generally includes, but is not limited to, the following steps: (a) β forging the ingot above $T_\beta$ to form an intermediate slab; (b) α-β forging the intermediate slab at a temperature below $T_\beta$; (c) α-β rolling the slabs to form plates; and (d) annealing the plates. The method also can involve the step of β annealing the intermediate slab prior to the step of α-β forging.

The step of heating the ingot to a temperature greater than $T_\beta$ generally comprises heating the ingot to a temperature of from about 1,900° F. to about 2,300° F., with 2,100° F. being a currently preferred temperature for this step. The step of α-β forging the intermediate slabs at a temperature below $T_\beta$ comprises forging the slabs at a temperature of from about 1,550° F. to about 1,775° F., and more generally from about 1,700° F. to about 1,775° F.

α-β processing also can comprise β forging the ingot to form intermediate slabs, α-β forging the intermediate slabs at a temperature below $T_\beta$, and α-β rolling the final slabs to produce plates, whereby the steps of α-β forging and rolling the final slabs to form plates achieves a percent reduction of at least about 50% in an α-β temperature range. The plates are then annealed. The step of α-β forging the slabs at a temperature below $T_\beta$ and rolling the slabs to produce plates preferably achieves a percent reduction of from about 70% to about 92% in an α-β temperature range.

Alloys produced according to the present invention have been used to make ballistic plates. Alloys with the best ballistic properties when formed into plates have comprised from about 2.9% to about 5.0% aluminum, from about 2.0% to about 3.0% vanadium, from about 1.45% to about 1.7% iron, and from about 0.23% to about 0.3% oxygen. Such armor plates with thicknesses of from about 0.625 inch to about 0.679 inch (about 15.9 to about 17.2 mm) have $V_{50}$ values of at least as high as 575 m/s, generally greater than about 600 m/s, and preferably greater than about 620 m/s, as determined by 20 mm FSP ballistic tests.

DETAILED DESCRIPTION OF THE PREFERRED EMBODIMENTS

Figure 1:
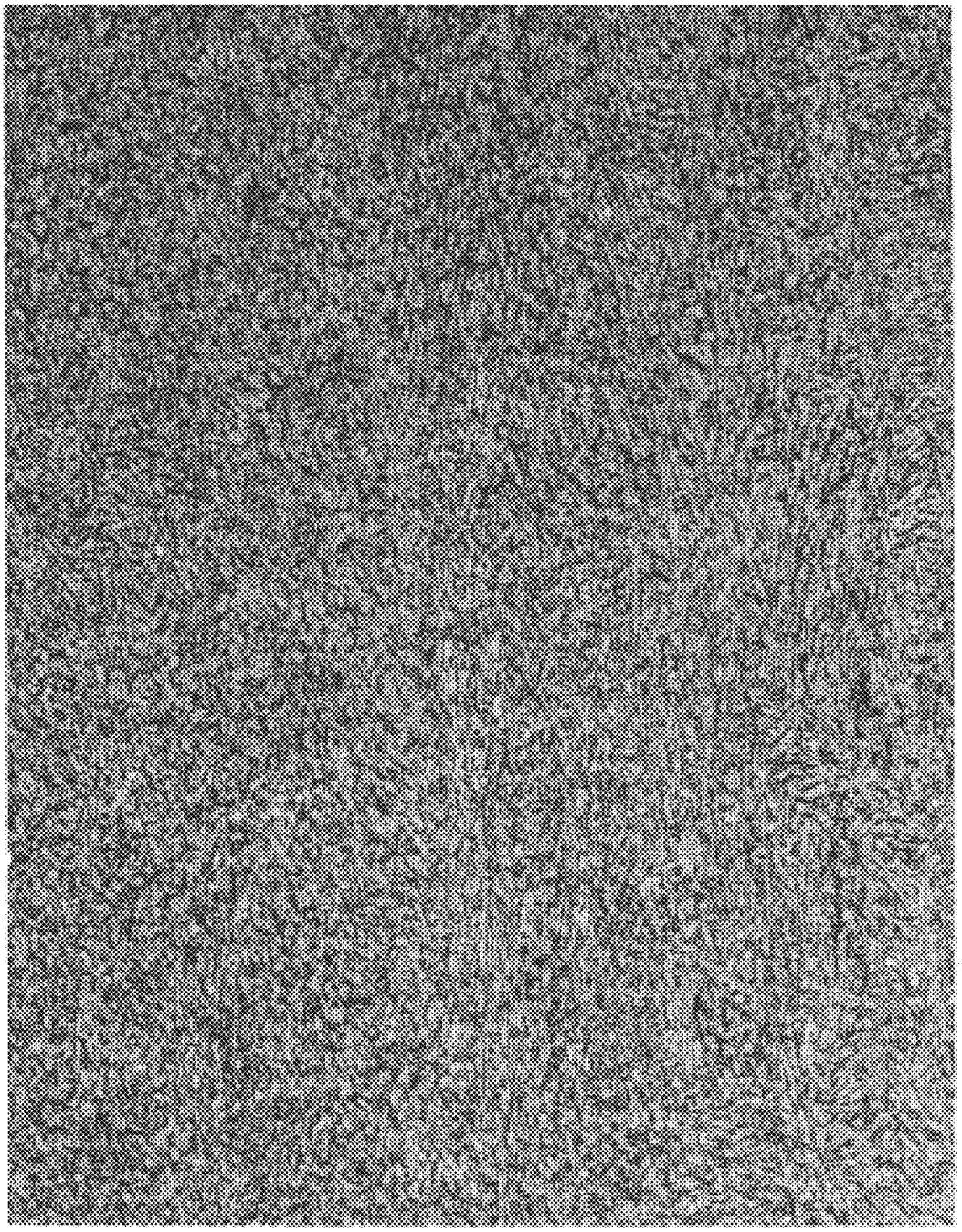
FIG. 1 is photomicrograph illustrating the α-β microstructure of alloys made according to the present invention.

The present titanium alloys can be fashioned into a variety of useful devices, including structural devices and ballistic armor. The present alloys are particularly useful for forming ballistic armor plates that, when fashioned into plates of about 16 mm thick, have $V_{50}$ values of about 600 m/s or greater. The composition of such alloys, i.e., the elements used to form the alloys and the relative weight percents thereof, as well as the methods for making armor plates using such alloys, are described below. Ballistic tests were conducted on plates fashioned from the alloys to determine, amongst other things, $V_{50}$ values. These results also are provided below.

I. COMPOSITION

The alloys of the present invention comprise primarily titanium, and if only the other alloying elements are stated it is to be understood that the balance is titanium. Other than titanium, the present alloys also generally include aluminum, vanadium, iron, oxygen, chromium, nickel, carbon, nitrogen, and perhaps other elements in trace amounts.

A. Aluminum

The titanium alloys of the present invention generally include less than about 5.4% aluminum, and preferably equal to or less than about 5.0% aluminum. Alloys having good ballistic properties when formed into plates have from about 2.5% to about 5.4% aluminum. Plates with the best $V_{50}$ values have been made using alloys having from about 2.9% to about 5.0% aluminum, and even more preferably from about 2.9% to about 4.0% aluminum.

B. Vanadium

The titanium alloys of the present invention generally include less than about 3.4% vanadium. Alloys having good ballistic properties when formed into plates have had from about 2.0% to about 3.4% vanadium. Plates with the best $V_{50}$ values have been made using alloys having from about 2.0% to about 3.0% vanadium, and preferably from about 2.0% to about 2.6%.

C. Iron

The alloys of the present invention differ significantly from the common Ti—6Al—4V alloys in a number of respects, including the iron and oxygen concentrations. Common Ti—6Al—4V alloys have relatively low iron concentrations of about 0.2% or less, whereas titanium alloys of the present invention have iron concentrations generally equal to or greater than about 0.2%. Plates having good ballistic properties can be made from alloys having from about 0.2% to about 2.0 % iron, typically from about 0.25% to about 1.75%, with the best ballistic results currently being obtained using alloys having from about 1.45% to about 1.6% iron.

D. Oxygen

The alloys of the present invention include relatively high oxygen concentrations. "High oxygen" concentration is defined herein as greater than or equal to 0.2%. The oxygen concentration of the present titanium alloys generally is greater than about 0.2% and generally less than about 0.3%, with the best ballistic results currently being obtained using alloys having from about 0.24% to about 0.29% oxygen.

E. Other Elements

As stated above, alloys of the present invention also generally include elements other than aluminum, vanadium, iron and oxygen. These other elements, and their percents by weight, typically are as follows: (a) chromium, 0.1% maximum, generally from about 0.001% to about 0.05%, and preferably to about 0.03%; (b) nickel, 0.1% maximum, generally from about 0.001% to about 0.05%, and preferably to about 0.02%; (c) carbon, 0.1% maximum, generally from about 0.005% to about 0.03%, and preferaby to about 0.01%; and (d) nitrogen, 0.1% maximum, generally from about 0.001% to about 0.02%, and preferably to about 0.01%.

A summary of the compositions of alloys made in accordance with the present invention is provided below in Table 1.

TABLE 1

ALLOY COMPOSITION

| Alloying Element | Percent by Weight |
|---|---|
| Aluminum | from about 2.5% to about 5.4% |
| Vanadium | from about 2.0% to about 3.4% |
| Iron | from about 0.2% to about 2.0% |
| Oxygen | from 0.2% to about 0.3% |
| Chromium | 0.1% maximum, and generally from about 0.001% to about 0.05% |
| Nickel | 0.1% maximum, and generally from about 0.001% to about 0.05% |
| Carbon | 0.1% maximum, and generally from about 0.005% to about 0.03% |
| Nitrogen | 0.1% maximum, and generally from about 0.001% to about 0.02% |
| Titanium and trace elements | balance |

II. α-β PROCESSING

Alloys having the elements discussed above, and the relative weight percents thereof, are processed to obtain products having desired characteristics and a mixed α+β microstructure. See, FIG. 1. The general processing steps for forming armor plates in accordance with the present invention are referred to herein as α-β processing steps. The α-β processing steps include: (1) forming ingots from alloys having the compositions discussed above; (2) forging the ingots to form intermediate slabs; (3) rolling the slabs to form plates; and (4) annealing the plates. The alloys also may be subjected to other, generally less important, processing steps. For example, plates made from such alloys also may be subjected to surface treatments.

A. Forming Ingots

One object of the present invention is to decrease the cost of producing armor plates by using scrap and waste materials to form ingots. A principle source of metal for forming the ingots is scrap metal from Ti—6Al—4V alloys. The ingots need not be formed solely from scrap and/or waste material. Previously unused metals, referred to as virgin materials, also can be used. Thus, ingots having the compositions stated above are formed by conventional methods from raw materials selected from the group consisting of scrap metals and alloys, recycled metals and alloys, virgin metals and alloys, and mixtures thereof. Scrap and/or waste metals and alloys currently are preferred primarily because such materials reduce the cost of making ingots.

B. Forging and Rolling

1. Forging Temperatures

Armor plates having excellent ballistic properties have been made using two primary forging steps. The first β forging step forms intermediate slabs and is carried out above β transus ($T_\beta$). β transus is the lowest temperature at which 100% of the alloy exists as the β phase. The α phase can exist at temperatures lower than $T_\beta$. The second α-β forging step is at temperatures below $T_\beta$.

For the first β forging step above $T_\beta$, ingots generally are heated to temperatures above about 1,900° F. The maximum temperature for this first forging step is not as important. It currently is believed that the temperature can be at least as high as about 2,300° F. 2,100° F. is a currently preferred temperature for forging ingots above $T_\beta$.

Slabs forged above $T_\beta$ are subjected to the second α-β forging step in an α+β temperature range. Temperatures of from about $T_\beta$ minus 50° F. to about $T_\beta$ minus 200° F., such as from about 1,500° F. to about 1,775° F., and more generally from about 1,700° F. to about 1,775° F., provide a working temperature range for performing the second forging step.

An optional β annealing and water quenching step also can be used to produce the alloys of the present invention. The β annealing and water quenching step generally is implemented after the β forging step and prior to the α-β forging step. The purpose of the β annealing step is to recrystallize β grains.

2. Percent Reduction

Instead of stating particular forging temperatures, the intermediate forging step also can be specified with reference to the "percent reduction" achieved by the forging step and subsequent rolling steps, which are discussed below. Percent reduction is calculated by subtracting the final slab thickness from the beginning slab thickness, dividing the result by the initial slab thickness and multiplying the result by 100. For example, if a 3-inch slab is forged to a 1-inch slab, the percent reduction is 3−1=2÷3=0.67×100=67.0%.

For α-β forging at temperatures below $T_\beta$ and for the subsequent α-β rolling steps, the percent reduction should be at least about 50.0%, more commonly about 60.0%, and preferably from about 70.0% to about 92.0%. Plates having good ballistic properties have been made by achieving a percent reduction of about 87.0% during the α-β forging and subsequent rolling steps.

The slabs can be cross rolled, long rolled, or both, during production and still have good ballistic properties. "Cross rolled" and "long rolled" are defined relative to the rolling direction used to roll the final plate. Cross rolling is rolling at 90° to the final rolling direction; long rolling is rolling parallel to the final rolling direction. There does appear to be some difference in the ballistic properties depending upon the rolling regimen, as illustrated in the examples provided below.

C. Annealing

Plates processed as discussed above are then annealed, and particularly mill annealed. Mill annealing is one type of annealing commonly practiced to provide an article having even α+β microstructure throughout. Armor plates having good ballistic properties have been mill annealed at temperatures of from about 1,300° F. to about 1,500° F. 1,400–1,450° F. is a common temperature range selected for mill annealing using a vacuum creep flattener.

D. Surface Treatments

Plates fashioned as described above can be subjected to various, and generally conventional, surface conditioning treatments. Examples of such surface conditioning procedures include, without limitation, grinding, machining, shot-blasting and/or pickling (i.e., bathing a metal in an acid or chemical solution to remove oxides and scale from the metal surface).

III. EXAMPLES

The following examples illustrate particular alloys and the processing steps to which such alloys were subjected to form plates having good ballistic properties. These examples are provided solely to illustrate certain features of the invention and should not be construed to limit the invention to the particular features described.

Example 1

An ingot was produced from compacts made from raw materials using double vacuum arc remelt (VAR) technology. A sample was taken from the middle surface of the ingot for chemical analysis. The composition of this alloy No. 1, and its $T_\beta$, are stated below in Table 2. Alloy No. 1 also is referred to as Ti—5Al—3V-High O (high oxygen) to reflect weight-percent approximations for the constituent elements.

TABLE 2

Chemical Analyses

| | Al | V | Fe | Cr | NI | O | C | N | $T_\beta$(F.) |
|---|---|---|---|---|---|---|---|---|---|
| Alloy #1 | 4.95 | 3.04 | 0.26 | 0.001 | 0.012 | 0.242 | 0.007 | 0.007 | 1825° |

An ingot having the chemical composition stated in Table 2 was then forged into slabs using a 500 ton forgepress. The slabs were soaked at 2,100° F. for 4 hours and then β forged from 7¾ inches to 5 inches. An intermediate slab was α-β forged to 3 inches after heating the slab at 1,775° for about 2 hours. The surfaces of the slabs were conditioned.

The slabs were then α-β hot rolled to form plates. Different hot rolling regimens were used to investigate the effects of rolling on ballistic properties. These hot rolling procedures are summarized in Table 3.

TABLE 3

Pass Schedule For Hot Rolling Plates

| | Alloy #1, Plate A | Alloy #1, Plate B |
|---|---|---|
| First Rolling | 1) 1,700° F. (927° C.) × 2 hrs. | 1) 1,700° F. (927° C.) × 2 hrs. |
| | CROSS ROLL | LONG ROLL |
| | (2.5") − 2.3" − 2.1" − 1.9" − 1.7" − 1.5" − 1.3" | (2.55") − 2.3" − 2.1" − 1.9" − 1.7" − 1.5" − 1.3" |
| Second Rolling | 2) 1,700° F. (927° C.) × 2 hrs. | 2) 1,700° F. (927° C.) × 2 hrs. |

TABLE 3-continued

| Pass Schedule For Hot Rolling Plates | |
|---|---|
| Alloy #1, Plate A | Alloy #1, Plate B |
| LONG ROLL | LONG ROLL |
| (1.3") – 1.1" – 0.9" – 0.8" – 0.7" – 0.63" | (1.3") – 1.1" – 0.9" – 0.8" – 0.7" – 0.63" |

Plates produced by the stated rolling procedures were mill annealed using a vacuum creep flattener (VCF) at approximately 1,450° F. The plates also were shot blasted and pickled. Large square plates were then cut for ballistic tests.

Example 2

This example concerns a second alloy, referred to either as alloy number 2 (Table 4) or Ti—4Al—2.5V—1.5Fe-High O. Compacts for ingot formation were formed from raw materials and ingots were produced from such compacts by VAR. The chemical composition for alloy number 2 and its $T_\beta$ are stated in Table 4.

TABLE 4

| Chemical Analyses | | | | | | | | | |
|---|---|---|---|---|---|---|---|---|---|
| | Al | V | Fe | Cr | Ni | O | C | N | Tβ(F.) |
| Alloy #2 | 3.98 | 2.56 | 1.58 | .003 | .014 | .234 | .008 | .006 | 1764° |

Ingots having the stated chemical analysis were forged to slabs using a 500 ton forgepress. The slabs were soaked at 2,100° F. for 4 hours and then β forged from 7¾ inches to 5 inches to form an intermediate slab. The intermediate slab was α-β forged after heating at 1,700° F. for 2 hours to form final slabs. The surfaces of the final slabs were conditioned.

The slabs were α-β hot rolled to form plates. These plates also were subjected to different hot rolling regimens to investigate the effects of rolling on ballistic properties. These rolling procedures are summarized in Table 5.

TABLE 5

| Pass Schedule For Hot Rolling Plates | | |
|---|---|---|
| | Alloy #2, Plate A | Alloy #2, Plate B |
| First Rolling | 1) 1,600° F. (871° C.) × 2 hrs. CROSS ROLL (2.75") – 2.6" – 2.3" – 2.1" – 1.9" – 1.7" – 1.5" – 1.3" | 1) 1,700° F. (927° C.) × 2 hrs. CROSS ROLL (2.8") – 2.6" – 2.3" – 2.1" – 1.9" – 1.7" – 1.5" – 1.3" |
| Second Rolling | 2) 1,600° F. (871° C.) × 2 hrs. LONG ROLL (1.3") – 1.1" – 0.9" – 0.8" – 0.7" – 0.63" | 2) 1,700° F. (927° C.) × 2 hrs. LONG ROLL (1.3") – 1.1" – 0.9" – 0.8" – 0.7" – 0.63" |

After the slabs were rolled as discussed above, the slabs were mill annealed using a vacuum creep flattener (VCF) at approximately 1,450° F. The plates were shot blasted and pickled, and then large square plates were cut for ballistic tests.

The mechanical properties of plates produced as stated above in Examples 1 and 2 are provided below in Table 6.

TABLE 6

| Physical Properties | | | | | | | | | | |
|---|---|---|---|---|---|---|---|---|---|---|
| | | | | Tensile Property | | | | Charpy Impact | | |
| Plate | Rolling Condition | Alloy Type | Direction | 0.2% PS[1] ksi | TS[2] ksi | El[3] % | RA[4] % | Side Not. ft-lb | Surface Not. ft-lb | Hardness BHN |
| Alloy #1, Plate A | 1,700 F. Cross Roll | Ti-5Al-3V High O | LT | 133.2 | 142.1 | 16 | 41.9 | 16.0<br>16.0 | 19.0<br>20.0 | 280 |
| Alloy #1, Plate B | 1,700 F. Cross Roll | Ti-5Al-3V High O | LT | 132.7 | 142.0 | 17 | 42.0 | 17.5<br>15.5 | 19.0<br>17.0 | 258 |
| Alloy #2, Plate A | 1,600 F. Cross Roll | Ti-4Al-2.5V-1.5Fe High O | LT | 129.9 | 138.7 | 17 | 49.5 | 14.0<br>14.0 | 13.0<br>13.0 | 276 |
| Alloy #2, Plate B | 1,700 F. Cross Roll | Ti-4Al-2.5V-1.5Fe High O | LT | 131.8 | 142.7 | 17 | 44.3 | 11.5<br>12.0 | 15.0<br>12.5<br>13.5 | 272 |
| Standard 6:4 Alloy | Production | Ti-6Al-4V Standard | L | 132.8 | 145.3 | 16 | 31.9 | 17.0<br>16.5 | 28.0<br>29.0 | 284 |

[1]PS refers to proof stress.
[2]TS refers to tensile strength.
[3]El refers to elongation.
[4]RA refers to reduction of area.

The "standard" alloy referred to in Table 6 is a common Ti—6Al—4V alloy comprising 6.25% aluminum, 3.97% vanadium, 0.169% iron, 0.019% chromium, 0.020% nickel, 0.182% oxygen, 0.022% carbon and 0.006 percent nitrogen.

Example 3

Seven laboratory ingots were produced by double vacuum arc remelting VAR. The chemistries of ingots 5–8 and 10–12 are provided by Table 7.

TABLE 7

Chemistry of Alloys 5–8, and 10–12

| Alloy No. | $T_\beta$ (° F.) | Al | V | Fe | Cr | Ni | O | C | N |
|---|---|---|---|---|---|---|---|---|---|
| 5 | 1735 | 4.03 | 2.56 | 1.49 | 0.023 | 0.015 | 0.154 | 0.007 | 0.007 |
| 6 | 1828 | 3.93 | 2.38 | 0.84 | 0.020 | 0.013 | 0.327 | 0.007 | 0.004 |
| 7 | 1823 | 4.02 | 4.02 | 0.22 | 0.022 | 0.014 | 0.270 | 0.009 | 0.004 |
| 8 | 1764 | 3.10 | 2.01 | 1.53 | 0.020 | 0.013 | 0.299 | 0.008 | 0.005 |
| 10 | 1801 | 3.97 | 2.52 | 1.52 | 0.015 | 0.012 | 0.318 | 0.004 | 0.004 |
| 11 | 1758 | 2.98 | 2.03 | 1.48 | 0.015 | 0.011 | 0.260 | 0.006 | 0.003 |
| 12 | 1735 | 3.86 | 2.55 | 1.47 | 0.016 | 0.011 | 0.150 | 0.006 | 0.008 |

Ingots having the alloy compositions stated in Table 7 were forged into slabs using a 500 ton forge press. Initially, these ingots were soaked at 2,100° F. for four hours and then β forged from about 7¾ inches to about 5 inches. The intermediate slabs were α-β forged to about 3 inches after heating at β transus minus between about 56° F. and about 89° F. for about two hours. After the slab surfaces were conditioned, the surface-conditioned slabs were again heated at temperatures of between β transus minus about 56° F. and about 89° F. for about two hours. The slabs were then hot rolled to 1.3 inches by cross rolling. Finally, these plates were reheated at temperatures of between β transus minus about 56° F. and about 89° F. for about two hours, then hot rolled to 0.63 inch in the longitudinal direction. These plates were mill annealed using a vacuum creep flattener at approximately 1,450° F., then shot blasted and pickled.

IV. BALLISTIC PROPERTIES

Plates produced as described above were tested by the U.S. Army Research Laboratory, at Aberdeen Proving Ground, Maryland, to determine $V_{50}$ values. U.S. Army Test and Evaluation Command, Test Operating Procedure 2-2-710, was used to determine the $V_{50}$ values.

The test projectile used was a 20 mm fragment-simulating projectile. Fragments from artillery shells generally are considered better at showing differences in titanium performance than armor-piercing projectiles. The 20 mm fragment-simulating projectile (FSP) simulates the steel fragments ejected from highly explosive artillery rounds, which remain a reasonable threat for modern armors. The 20 mm FSP was manufactured from 4340H steel, having $R_C$ 29–31 hardness, in accordance with specification MIL-P46593A, and was fired from a 20 mm rifled Mann barrel.

Projectile velocities were measured using an orthogonal flash X-ray system. See, Grabarek et al's *X-Ray Multi-Flash System for Measurements of Projectile Performance at the Target, BRL Technical Note* 1634 (September, 1966).

Table 8 below lists the plate numbers, the $V_{50}$ velocities, and standard deviations that were obtained by the ballistic tests for plates made from alloys 1 and 2. No cracks were observed following ballistic tests on plates made from alloys 1 and 2. The plate thicknesses vary slightly; as a result, the $V_{50}$ results were normalized to a single reference thickness of 16.50 mm (0.650"). Equation 1 is the normalization equation used to normalize the data.

$$V_{NORM}=V_{TEST}-31.6T+521.4 \qquad \text{EQUATION 1}$$

"T" is plate thickness in millimeters, $V_{NORM}$ is the normalized $V_{50}$ in meters per second, and $V_{TEST}$ is the $V_{50}$ in meters per second obtained by testing the plates.

TABLE 8

Ballistic Properties of Plates Made from Alloys 1 and 2

| Plate # | Thickness (mm) | Tested $V_{50}$ (m/s) [$V_{TEST}$] | Std Dev (m/s) | Normalized $V_{50}$ (m/s) [$V_{NORM}$] | MIL-A-46077 (m/s) |
|---|---|---|---|---|---|
| 1A | 16.26 | 591 | 15 | 599 | 595 |
| 1B | 16.10 | 611 | 6 | 624 | 591 |
| 2A | 16.89 | 632 | 5 | 620 | 612 |
| 2B | 16.23 | 658 | 2 | 667 | 594 |
| Standard | 16.59 | 532 | 7 | 529 | 604 |

TABLE 9

Ballistic Properties of Plates Made from Alloys 5–8 and 10–12

| Plate No. | Thickness (mm) | Tested $V_{50}$ (m/s) | Standard Deviation (m/s) | Normalized $V_{50}$ (m/s) | MIL-A-46077 (m/s) | Difference Tested V50-MIL (m/s) | Through Cracks Greater Than 2.5" |
|---|---|---|---|---|---|---|---|
| 5 | 15.65 | 541 | 11 | 552 | 577 | −36 | No |
| 6 | 14.83 | 570 | 8 | 607 | 551 | 19 | Yes |
| 7 | 15.82 | 594 | 9 | 600 | 582 | 12 | No |
| 8 | 16.59 | 635 | 6 | 616 | 606 | 21 | No |
| 10 | 15.95 | 573 | N/A* | 575 | 586 | −13 | Yes |
| 11 | 16.46 | 653 | 6 | 639 | 602 | 51 | No |
| 12 | 16.54 | 592 | 21 | 575 | 605 | −13 | No |

*Standard deviation is not available.

Tables 8 and 9 show that plates produced from alloys described herein had $V_{50}$ values of at least as high as 590 m/s, and typically above 600 m/s. The plates had $V_{50}$ values at least equivalent to that specified by MIL-A-46077 for Ti—6Al—4V ELI plates. The $V_{50}$ values for plates made from the present alloys are significantly higher than the $V_{50}$ reported for the standard Ti—6Al—4V alloy. Furthermore, alloy 2, both plates A and B, had $V_{50}$ values of at least 90 m/s higher than the $V_{50}$ value reported for the standard. Table 8 and the rolling regimens stated for the plates, particularly the ballistic properties reported for plates 2A and 2B, indicate that the best ballistic properties are achieved by rolling at temperatures of $T_\beta$ minus less than about 100° F., such as $T_\beta$ minus from about 50° F. to about 90° F.

Table 9 shows that plate numbers 7, 8 and 11 have higher $V_{50}$ values than that required by MIL-A-46077. The chemistry of the alloys used to make these plates is as stated herein for the present invention.

Alloys of the present invention typically have oxygen contents of from about 0.2% to about 0.3. Table 9 shows that plates 5 and 12, which were made using alloys having lower oxygen contents than that of alloys made in accordance with the present invention, namely 0.154 and 0.150 respectively, have lower $V_{50}$ values than that required by MIL-A-46077. The alloy used to produce plate 6 had an oxygen content of 0.327, i.e., a higher oxygen content than that of alloys made in accordance with the present invention. Although plate 6 exhibited a higher $V_{50}$ value than that required by MIL-A-46077, it also developed sever cracks during the ballistic tests. Such cracks make ballistic plates less desirable, and even unuseable if the cracks are too extensive.

The alloy used to make plate 10 also had an oxygen content greater than 0.3, namely 0.318. Plate 10, which was made from alloy number 10, developed sever cracks during ballistic tests, and also had a lower $V_{50}$ value than that required by MIL-A-46077.

Thus, tables 8 and 9 demonstrate that armor plates made in accordance with the present invention typically have $V_{50}$ values greater than about 575 m/s, many have $V_{50}$ values greater than about 600 m/s, and some have $V_{50}$ values greater than 625 m/s. Armor plates made having oxygen contents greater than 0.3% may have reasonably high $V_{50}$ values, but the cracks that develop in such plates may be too sever to use the plates as ballistic armor. No cracks were observed in ballistic plates made from alloys 1 and 2 following ballistic tests.

The present application has been described with reference to preferred embodiments. It will be understood by persons of ordinary skill in the art that the invention can vary from that described herein, and still be within the scope of the following claims.

I claim:

1. An α-β titanium alloy, comprising:

from about 2.9% to about 5.0% aluminum;

from about 2.0% to about 3.0% vanadium;

from about 0.4% to about 2.0% iron;

greater than 0.2% to about 0.3% oxygen;

from about 0.005% to about 0.03% carbon;

from about 0.001% to about 0.02% nitrogen; and less than about 0.5% of elements other than titanium.

2. The alloy according to claim 1 comprising from about 2.9% to about 4.0% aluminum.

3. The alloy according to claim 1 comprising from about 2.9% to about 5.0% aluminum, and from about 2.0% to about 3.0% vanadium.

4. The alloy according to claim 3 comprising from about 2.9% to about 4.0% aluminum.

5. The alloy according to claim 1 comprising from about 0.25% to about 1.75% iron.

6. The alloy according to claim 3 comprising from about 1.45% to about 1.6% iron.

7. The alloy according to claim 3 comprising from about 0.24% to about 0.29% oxygen.

8. The alloy according to claim 1 and further comprising elements selected from the group consisting of chromium, nickel, carbon, nitrogen, niobium, cobalt, and mixtures thereof.

9. The alloy according to claim 1 comprising from about 2.9% to about 5.0% aluminum, from about 2.0% to about 3.0% vanadium, from about 1.25% to about 1.75% iron, and from about 0.23% to about 0.25% oxygen.

10. An α-β titanium alloy consisting essentially of:

from about 2.9% to about 5.0% aluminum;

from about 2.0% to about 3.0% vanadium;

from about 0.4% to about 1.75% iron;

greater than 0.2% to about 0.3% oxygen;

from about 0.005% to about 0.03% carbon;

from about 0.001% to about 0.02% nitrogen; and one or more elements selected from the group consisting of chromium, nickel, niobium, and cobalt, wherein the weight percent of each such element is 0.1% or less, and wherein the total weight of such element is about 0.5% or less.

11. An armor plate comprising an α-β processed titanium alloy comprising from about 2.9% to about 5.0% aluminum, from about 2.0% to about 3.0% vanadium, from about 0.4% to about 2.0% iron, greater than 0.2% to about 0.3% oxygen, from about 0.005% to about 0.03% carbon, from about 0.001% to about 0.02% nitrogen and less than about 0.5% of elements other than titanium.

12. The armor plate according to claim 11 having a thickness of from about 0.625 inch to about 0.679 inch and having a $V_{50}$ of at least as high as 575 m/s.

13. The armor plate according to claim 11 having a thickness of from about 0.625 inch to about 0.679 inch and having a $V_{50}$ of at least as high as 600 m/s.

14. The armor plate according to claim 11 comprising from about 2.9% to about 4.0% aluminum, from about 2.0% to about 3.0% vanadium, from about 1.25% to about 1.75% iron, and from about 0.23% to about 0.25% oxygen.

15. The armor plate according to claim 14 having a thickness of from about 0.625 inch to about 0.679 inch and having a $V_{50}$ of at least 600 m/s.

16. The armor plate according to claim 14 having a thickness of from about 0.625 inch to about 0.679 inch and having a $V_{50}$ of at least 620 m/s.

* * * * *